United States Patent [19]

Kato et al.

[11] 4,413,955

[45] Nov. 8, 1983

[54] SWASH PLATE COMPRESSOR

[75] Inventors: Kimio Kato; Hisao Kobayashi, both of Kariya; Takamitsu Mukai, Anjo; Hiroya Kono, Kariya; Taku Yamamoto, Obu, all of Japan

[73] Assignee: Kabushiki Kaisha Toyoda Jidoshokki Seisakusho, Kariya, Japan

[21] Appl. No.: 359,951

[22] Filed: Mar. 19, 1982

[30] Foreign Application Priority Data

Mar. 28, 1981 [JP] Japan ..... 56-45864

[51] Int. Cl.[3] ..... F04B 49/02; F04B 1/18

[52] U.S. Cl. ..... 417/270; 417/296; 417/297

[58] Field of Search ..... 417/296, 297, 299, 269, 417/270

[56] References Cited

U.S. PATENT DOCUMENTS

| | | | |
|---|---|---|---|
| 1,653,110 | 12/1927 | Le Valley | 417/296 |
| 2,726,032 | 12/1955 | Cooper et al. | 417/296 |
| 3,545,220 | 12/1970 | Teegardon | 417/299 |
| 3,611,715 | 10/1971 | Tatsutomi | 417/297 |
| 4,373,870 | 2/1983 | Dandzik | 417/269 |
| 4,381,178 | 4/1983 | Nakayama | 417/269 |

FOREIGN PATENT DOCUMENTS

| | | | |
|---|---|---|---|
| 2615627 | 10/1976 | Fed. Rep. of Germany | 417/297 |
| 55-160187 | 12/1980 | Japan | 417/270 |

*Primary Examiner*—William L. Freeh
*Attorney, Agent, or Firm*—Jordan and Hamburg

[57] ABSTRACT

A swash plate compressor especially suited for automotive vehicles. The inner housing may be moved in the rear housing in the front and rear direction, as the occasion may demand, for adjusting the compression capacity or performance of the compressor. A partition wall is projectingly projected at the front side of the inner housing for defining an inner or discharge chamber and an outer or suction chamber. A plurality of clamp bolts for fixedly clamping together a rear cylinder block and the rear housing are passed through said suction chamber. The rear wall of the inner housing is formed with an annular thin-walled portion lesser in thickness than the valve plate on the front surface of said inner housing. By the function of said thin-walled portion, the inner housing may be flexed readily to absorb valve plate strain.

5 Claims, 10 Drawing Figures

SWASH PLATE COMPRESSOR

FIELD OF THE INVENTION

This invention relates to a swash plate compressor especially suited for air-conditioning of automotive vehicles.

BACKGROUND OF THE INVENTION

In a certain conventional compressor used for air-conditioning of automotive vehicles, means are provided for adjusting the compression capacity or performance as a function of occasional cooling demand. The present inventor has proposed a compressor of this type in which, as shown in FIG. 9, an inner housing 62 movable axially of a rotary shaft is mounted in the rear housing 61 for providing a pressure chamber 63 between the inner surface of the rear housing 61 and the rear surface of the inner housing 62, a valve plate 64 is secured to the open front end face of the inner housing 62, and wherein a changeover valve 65 is provided for selective application of a high or discharge pressure or a low or suction pressure to said pressure chamber 63 to enable the compressor capacity to be switched between 100% value and 50% value to eliminate any unnecessary compression when the smaller compressor capacity is required.

However, with such swash plate compressor, a suction chamber 66 and a discharge chamber 67 are provided in the central and radially outward portions of the inner housing 62. Thus, when the front housing 68 and the rear housing 61 are secured to the front and rear cylinder blocks 69, 70 by through-bolts, the latter must be passed through the high-pressure discharge chamber 67, thus posing a serious sealing problem. Thus it is necessary, after securing the cylinder blocks 69, 70 to the front housing 68 by through-bolts 71, to fixedly clamp the rear cylinder block 70 and the rear housing 61 together by further clamp bolts 72, which are arranged radially outwardly of a sealing O-ring 73, as shown in FIG. 10, with consequent increase in the outside diameter of the compressor.

SUMMARY OF THE INVENTION

It is therefore an object of the present invention to provide a swash plate type compressor which can be switched between 100% operation and 50% operation as the occasion may require so that unnecessary compression may be dispensed with during low load operation for reducing the motive power and preventing undue heating of the compressor.

It is a further object of the present invention to provide a swash plate type compressor which may be reduced in size through reduction of the outside diameters of the rear cylinder block and the rear housing.

It is a further object of the present invention to provide a swash plate compressor wherein a portion of the inner housing is made flexible so as to absorb any strain experienced by a valve plate mounted to the front surface of the inner housing so that the valve plate may accurately and closely abut on the rear end face of the rear cylinder block for assuring fluid tightness.

It is a further object of the present invention to provide a swash plate compressor wherein the inner housing may have a simpler shape and the suction chamber positioned radially outwardly of the discharge chamber may be increased in volume.

It is a further object of the present invention to provide a swash plate compressor wherein the discharge pressure and the negative suction pressure developed in the compressor itself may be utilized as pressure sources for the pressure chamber which is disposed on the back surface of the inner housing.

Other objects of the present invention will be apparent from the following description of the preferred embodiments and the appended claims. Many advantages not specifically recited in the specification will readily be apparent to those engaged in the art upon execution of the present invention.

DETAILED DESCRIPTION OF THE PREFERRED EMBODIMENTS

Figure 1:
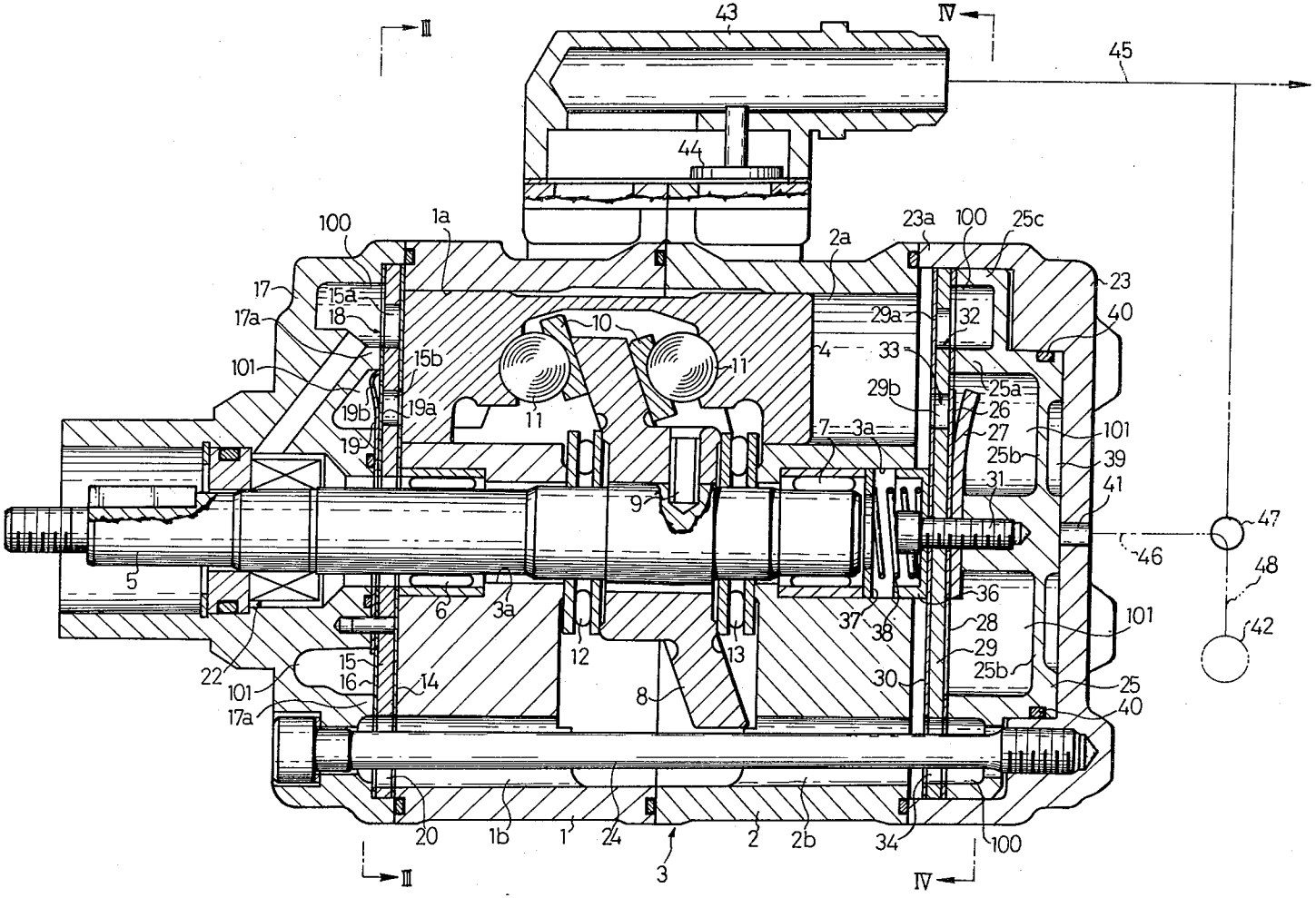
FIG. 1 is a central longitudinal section of a swash plate compressor according to a first embodiment of the present invention.

Referring to the first embodiment of the invention shown in FIGS. 1 through 5, the numerals 1 and 2 denote a fore cylinder block and an aft cylinder block constituting together a body member 3 of the compressor. Each of said cylinder blocks 1, 2 has for example five cylinder bores 1*a*, 2*a*, and a plurality of double-headed pistons 4 are slidably received in these cylinder bores 1*a*, 2*a*. A rotary shaft 5 is inserted into a center bore 3*a* of the body member 3 of the compressor from the front side and is mounted for rotation by bearing members 6 and 7. An inclined or swash plate 8 is secured to the central portion of the rotary shaft 5 by a spring pins 9. The arrangement is so made that, when the inclined plate 8 is rotated, said piston 4 may be reciprocated in the cylinder bores 1*a*, 2*a* through the intermediary of two pairs of shoes 10 and balls 11. In the drawing, the numerals 12, 13 denote thrust bearings.

Figure 3:
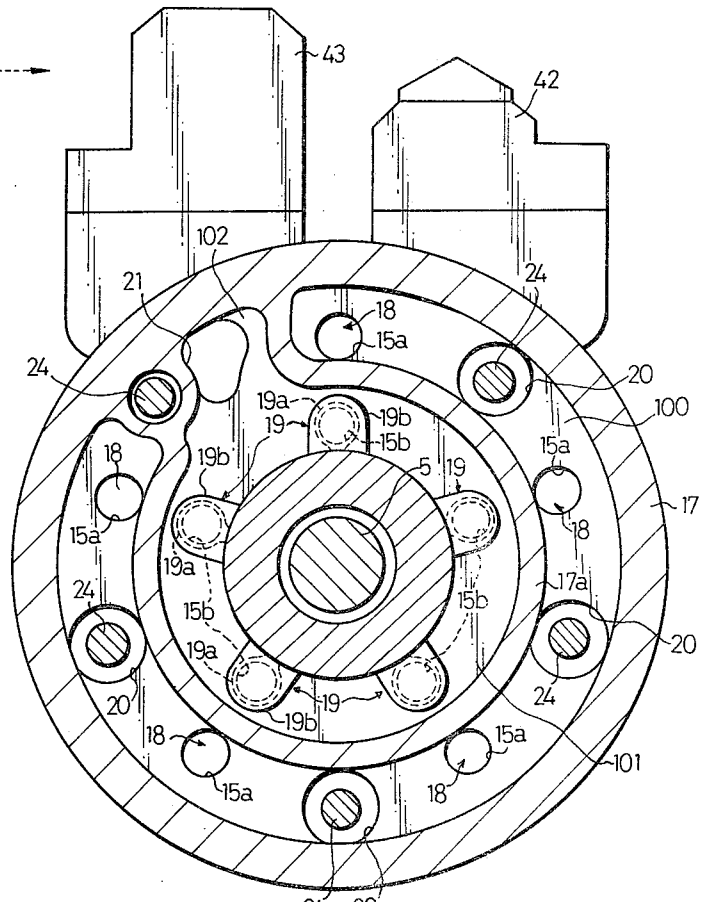
FIG. 3 is a section taken along line III—III of FIG. 1.

To the front end face of the fore cylinder block 1 is secured a front housing 17 through the intermediary of a suction valve seat 14, a valve plate 15 and a gasket 16. As shown in FIG. 3, this front housing 17 is divided by a substantially toroidal partition wall 17*a*, into an outwardly disposed suction chamber 100 and a centrally disposed discharge chamber 101. Five suction ports 15*a* are formed in the valve plate 15 in such positions as to suck refrigerant gas into each cylinder bore 1*a* from the common suction chamber 100 provided in said front housing 17, said suction ports 15*a* cooperating with valve plates, not shown, of the suction valve seat 14 for providing five suction valve 18. Said valve plate 15 also has five discharge ports 15*b* in such positions as to discharge the compressed refrigerant gas from each cylinder bore 1*a* into the common discharge chamber 101 provided in said front housing, said discharge ports 15*b* cooperating with valve plates 19*a* and retainers 19*b* for providing five discharge valves 19.

Four suction communication openings 20 are formed in said valve plate 15 for sucking refrigerant gas from a suction passage 1*b* of the front cylinder block 1 into the suction chamber 100. As shown in FIG. 3, the upper portion of the discharge chamber 101 of the front housing 17 is enlarged at 102, and a discharge communication opening 21 is provided in the valve plate 15 in register with the enlarged portion 102 for introducing the compressed refrigerant gas into a discharge passage 1*c* of the fore cylinder block 1 (see FIG. 5).

The foremost part of the rotary shaft 5 is passed through the center of the front housing 17 to be projected outwards and connected at the projected end to a drive source. Sealing means 22 are provided for sealing the rotary shaft 5 and the front housing 17 relative to one another.

Figure 4:
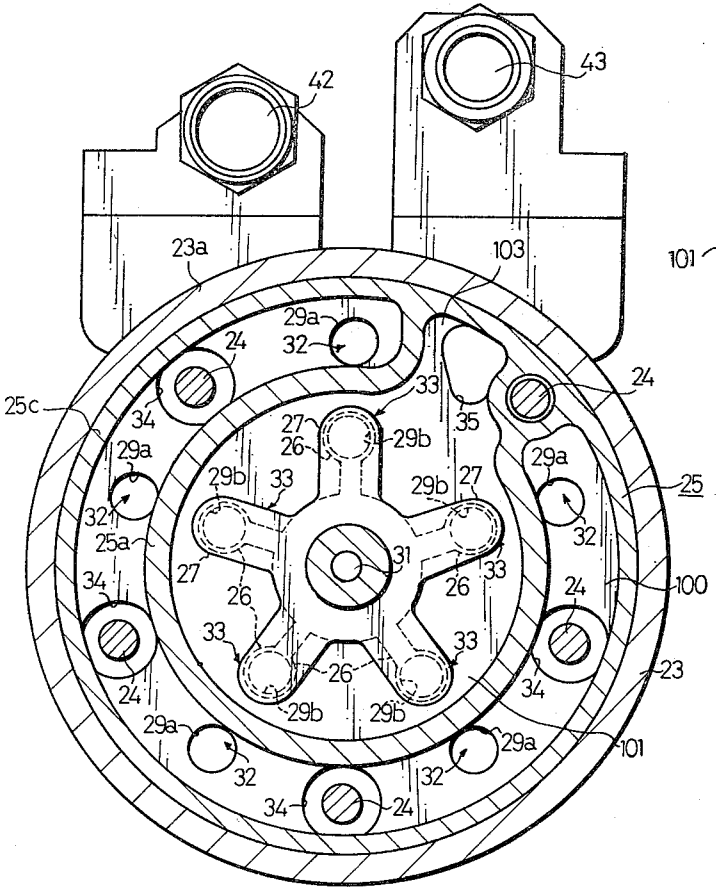
FIG. 4 is a section taken along line IV—IV of FIG. 1.

A rear housing 23 is connected to the outer edge of the rear end face of the rear cylinder block 2. The rear housing 23, front housing 17 and the cylinder blocks 1, 2 are fixedly clamped to one another by five through-bolts 24 which are passed through the suction chamber 100 of the front housing 17, suction communication opening 20 of the valve plate 15 and suction passages 1*b*, 2*b* of the cylinder blocks 1, 2. A bottomed cylindrical inner housing 25 is slidably introduced onto the inner peripheral surface of the rear housing 23 in the axial direction of the rotary shaft 5. As shown in FIG. 4, this inner housing 25 is divided by a substantially circular partition wall 25*a* into the outwardly disposed suction chamber 100 and the centrally disposed discharge chamber 101. The outer peripheral wall 23*a* of the rear housing 23 is inscribed by the outer peripheral wall 25*c* of the inner housing 25. A gasket 28, valve plate 29 and a suction valve seat 30 are secured by a small screw 31 to the front end face of the inner housing 25. Five suction ports 29*a* are provided in the valve plate 29 in such positions as to such refrigerant gas into each cylinder bore 2*a* from the common suction chamber 100 provided in the inner housing 25, said suction ports 29*a* cooperating with valve plates, not shown, of the suction valve seat 30 for providing suction valves 32. Five discharge ports 29*b* are provided in the valve plate 29 in such positions as to discharge the compressed refrigerant gas from each of the cylinder bores 2*a* into the common discharge chamber 101 defined in the inner housing 25, said discharge ports 29*b* cooperating with the valve plates 26 and the retainers 27 for providing discharge valves 33.

The valve plate 29 is formed with a plurality of suction communication openings 34 for passage of said through-bolts 24 therethrough to permit the refrigerant gas to be sucked from suction passage 2*b* of the rear cylinder block 2 into the suction chamber 100 of the inner housing 25. As shown in FIG. 4, the upper portion of the discharge chamber 101 of the inner housing 25 is enlarged at 103, and a discharge communication opening 35 is provided in the valve plate 29 in register with the enlarged portion 103 for introducing the compressed refrigerant gas into a discharge passage 2*c* of the rear cylinder block 2 (see FIG. 5).

A spring retaining member 36 is axially reciprocable within the center bore 3*a* of the body member 3 of the compressor and fixedly clamped by small screw 31 to the front face of the suction valve plate 30 at the center thereof. A compression coil spring 38 is interposed between the spring retaining member 36 and a spring retaining plate 37 abutted against the rear end face of the bearing member 7 so that the suction valve seat 30, valve plate 29 and the inner housing 25 are normally urged in a direction away from the rear end face of the rear cylinder block 2.

A gap is provided between the rear face of the inner housing 25 and the rear housing 23 for delimiting a pressure chamber 39. An O-ring 40 is fitted in an outer peripheral groove of the inner housing 25 for assuring air-tightness of the pressure chamber 39. An inlet opening 41 is formed through the rear housing 23 for communication with the pressure chamber 39. The rear surface of the inner housing 25 is formed with an annular reduced thickness portion 25*b* with thickness lesser than that of the valve plate 29. The arrangement is so made that, when the inner housing 25 and the valve plate 29 are clamped together by the small screw 31, the inner housing 25 may be deformed more readily so as to reduce the flexure imparted to the valve plate 29. Occasional strain caused by certain dimensional tolerances of the valve plates 26, retainers 27 and the gaskets 28 may also be absorbed by the reduced thickness portion 25*b*.

A suction flange 42 communicating with suction passages 1*b*, 2*b* of the cylinder blocks 1, 2 and a discharge flange 43 communicating with discharge passages 1*c*, 2*c* of the cylinder blocks 1, 2 are connected to the top of the body member 3 of the compressor. A check valve 44 is provided in the discharge passage 2*c* for preventing the reversed flow of the refrigerant gas into discharge chamber 101 of the inner housing 25. A discharge conduit 45 is connected to the discharge flange 43, an inlet conduit 46 is connected to the inlet opening 41, and a changeover valve 47 is connected to the conduits 45, 46, said changeover valve being operative when the suction pressure and temperature have exceeded their design valves. The numeral 48 denotes an inlet conduit interconnecting said suction flange 42 and the changeover valve 47.

The compressor so far shown and described operates as follows.

Upon starting the compressor, as shown in FIG. 1, the suction valve seat 30, valve plate 29, gasket 28 and the inner housing 25 are urged towards rear as one unit by the compression spring 38 so that the valve plate 29 clears the rear end face of the cylinder block 2 so as to permit the refrigerant to flow into and be discharged from all the cylinder bores 2*a* on the rear side. Thus the refrigerant does not meet any appreciable resistance thus causing no compression on the rear side. Since the compression occurs only on the front side, starting torque may be low.

Figure 2:
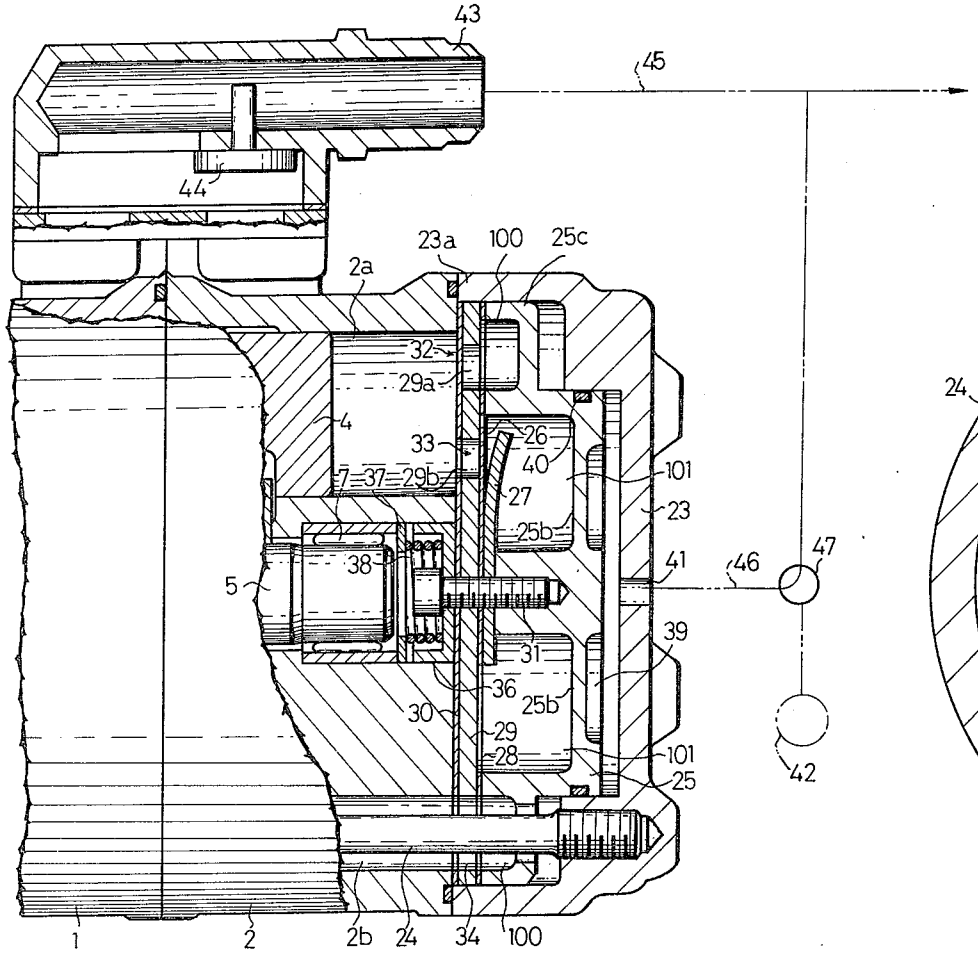
FIG. 2 is a partial section showing the inner housing when moved in the fore direction.
Figure 5:
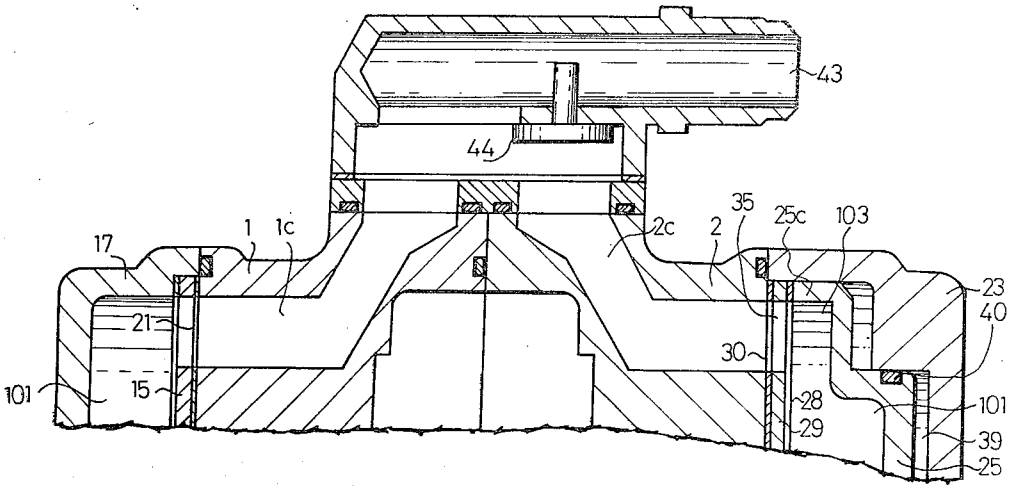
FIG. 5 is a partial section showing a portion including the discharge passage of the swash plate compressor according to the first embodiment.

With progress in the compression on the front side, when the pressure in the discharge chamber 101 has exceeded a predetermined value, a pressure switch, not shown, is energized. An electromagnet, not shown, provided in the changeover valve 47, is thereby turned on and, as shown in FIG. 2, the changeover valve 47 is switched to the side of the discharge flange 43. The discharge gas from the discharge flange 43 may thus be supplied through changeover valve 47 into pressure chamber 39. Under such discharge pressure, the inner housing 25 is pressed towards front against the compression spring 38 (FIG. 2) so that the suction valve seat 30 is closely abutted against the rear end face of the cylinder block 2. From this time on, compression occurs similarly on the side of the rear cylinder block 2.

When the compression has started on the rear side, the gas is supplied under pressure from discharge chamber 101 of the inner housing 25 through the discharge passage 2*c* and check valve 44 towards the discharge flange 43 to effect 100% operation of the compressor. During such compression operation, the cylinder bores 2*a* are placed sequentially under elevated pressure. Since the sectional area of the pressure chamber 39 is larger than the overall sectional area of the cylinder bores 2*a* occasionally placed under the elevated pressure acting on the valve plate 29 from the front side, the inner housing 25 is not floated during such compression operation. Since the back pressure acting on the back surface of the inner housing 25 corresponds to the differential sectional area between the inner and outer surfaces of the inner housing, there is no risk that the reduced thickness portion 25*b* may be destroyed due to abnormally increased back pressure.

Even supposing that the valve plate 29 is subjected to strain due to manufacturing and assembly tolerances and thus the suction valve seat 30 may not be contacted closely with the rear end face of the cylinder block 2, the inner housing 25 may be flexed under the back pressure applied to the inner housing 25 by virtue of the reduced thickness portion 25*b* so that the inner housing 25 is uniformly pressed at the front end face thereof against the valve plate 29 through the gasket 28. Thus the occasional strain to which valve plate 29 is subjected may be compensated, resulting in improved sealing between the gasket 28 and the rear end face of the cylinder block 2.

When the compressor may be switched in the course of its normal operation from 100% to 50% capacity, the changeover valve 47 is switched to the side of suction flange 42, as shown in FIG. 1, for establishing fluid communication between the inlet conduit 48 and the pressure chamber 39. The gas pressure in the pressure chamber 39 is now reduced and the inner housing 25 is shifted towards aft under the force of compression spring 38, thus making the action of compression at the rear side ineffective. At this time, reversed flow of the pressurized gas into the inner housing 25 may be prevented by the check valve 44.

A throttle valve, not shown, may be provided between the changeover valve 47 and the inlet opening 41 for preventing abrupt pressure rise in the pressure chamber 39 at the time of switching to 100% compressor operation and for reducing the torque as well as abrupt build-up of abnormally high pressure during start of the compressor. Alternatively, an intermediate pressure may be applied to the pressure chamber 39 during abnormally high pressure caused, for example, by liquid compensation, for preventing the risk of destruction of the reduced thickness portion 25*b* of the inner housing 25.

The changeover valve 47 may be switched by automatic changeover device and thus without resorting to manual operation or pressure switch operation.

Thus, according to the first embodiment of the present invention, the compressor capacity may be switched between two stages, i.e. between 100% operation and 50% operation, as the occasion may require, and a sufficient relief area may be procured by only small displacement of the inner housing 25. Thus any undue compression may be dispensed with during low load operation resulting in the reduced motive power and prevention of undue heating of the compressor.

According to the first embodiment of the present invention, the discharge chamber 101 and the suction chamber 100 are defined in the central zone and the outer peripheral zone of the inner housing 25 respectively and thus the through-bolts 24 used for securing the rear cylinder blocks 2 and the rear housing 23 to each other may be provided in the low-pressure suction chamber 100 where fluid tightness is not of primary importance. Thus, the rear cylinder block 2 and the rear housing 23 may be reduced in their outside diameters for reducing the overall size.

Figure 8:
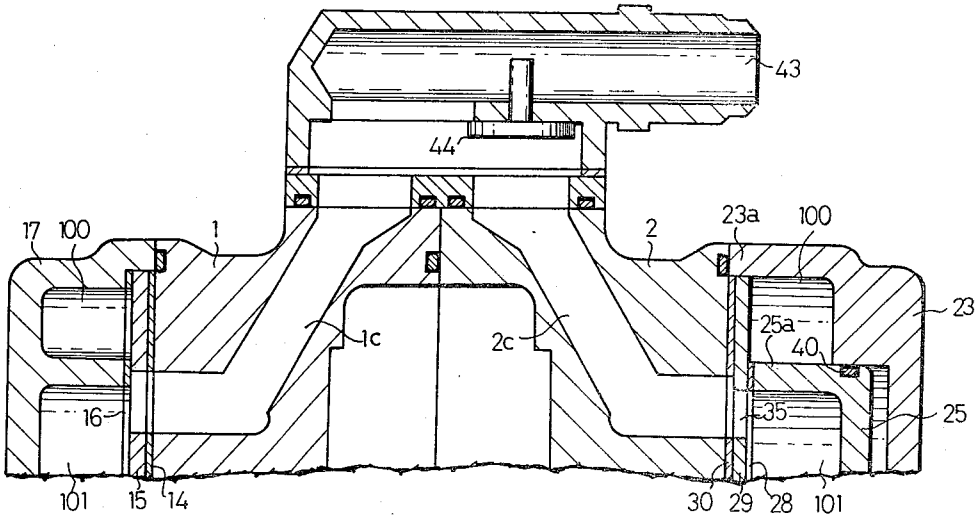
FIG. 8 is a partial section showing a portion including a discharge passage of the swash plate compressor according to the second embodiment.
Figure 7:
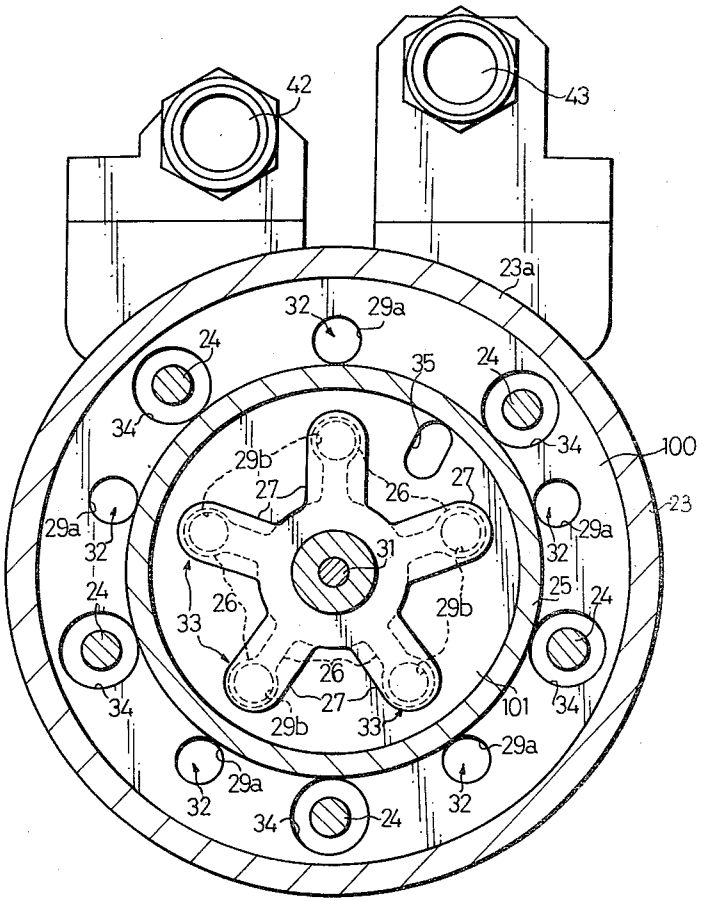
FIG. 7 is a section taken along line VII—VII of FIG. 6.
Figure 6:
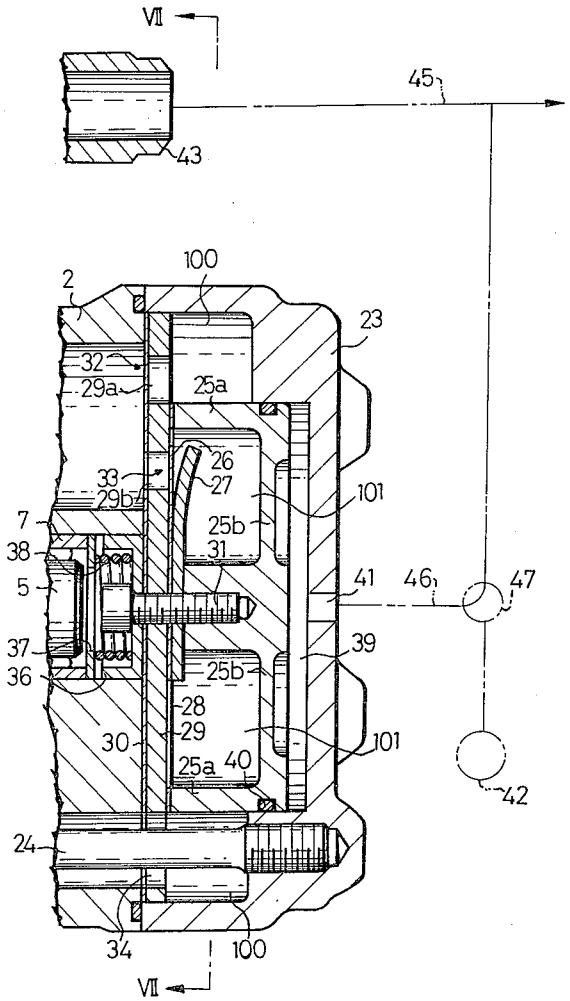
FIG. 6 is a partial section showing a swash plate compressor according to a second embodiment of the present invention.
Figure 9:
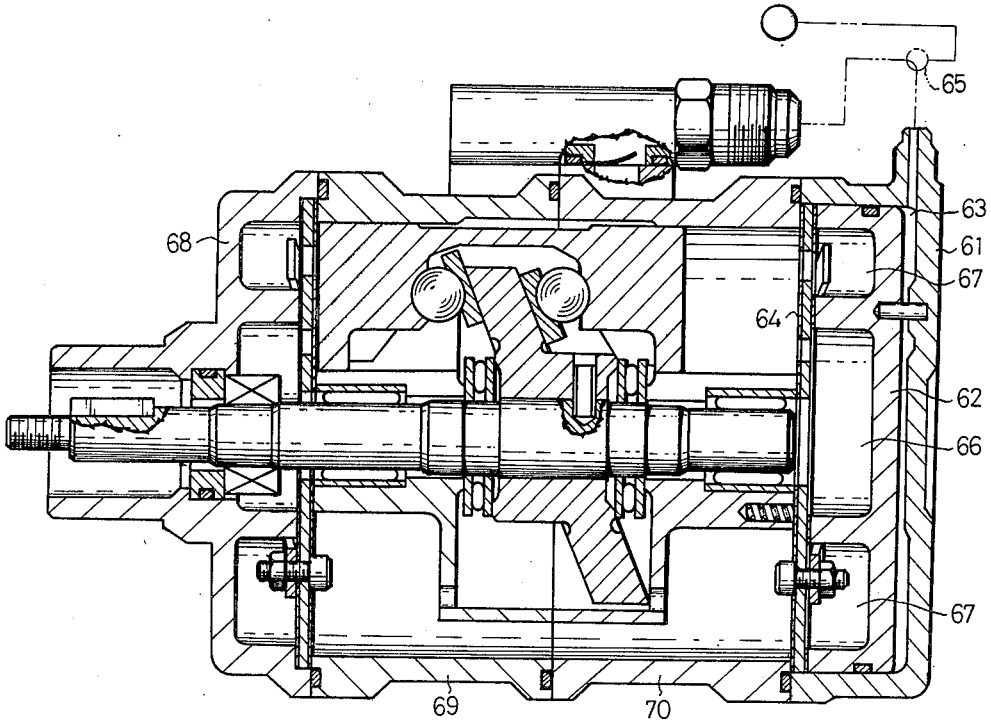
FIG.9 PRIOR ART
FIG. 9 is a section showing a conventional swash plate compressor.
Figure 10:
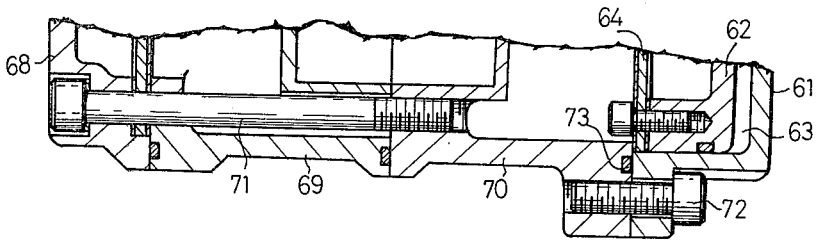
FIG. 10 PRIOR ART
FIG. 10 is a partial section showing the state of securing of the cylinder block and the rear housing in the conventional swash plate compressor.

Reference is made to FIGS. 6 through 8 for illustrating a second embodiment of the present invention. According to this embodiment, only the discharge chamber 101 is provided in the inner housing 25, whereas the suction chamber 100 is defined between the outer peripheral partition wall 25*a* of the inner housing 25 and the outer peripheral wall 23*a* of the rear housing 23. Thus the inner housing 25 may have a simpler shape, while the suction chamber 100 may be enlarged in volume. Other structure and effects of the present embodiment are similar to those already described in connection with the preceding embodiment. It is to be noted that, in this second embodiment, the partition wall 25*a* of the inner housing 25 and the discharge chamber 101 may be enlarged radially, and only the communicating portion of the discharge chamber 101 and the discharge passage 2*c* (i.e. discharge communication opening 35) may be provided in such radially enlarged portion.

It is evident that broadly different embodiments may be conceived within the spirit and scope of the present invention, and hence the present invention may not be restricted to the particular embodiment shown herein except as defined in the appended claims.

What is claimed is:

1. A swash plate compressor comprising, in combination, a main body of the compressor consisting of mutually connected front and rear cylinder blocks, a front housing and a rear housing respectively mounted to front and rear end faces of the body member by the medium of front and rear valve plates in each of which suction ports and discharge ports are provided, a rotary shaft inserted into the center bore of the body member from the front housing side, a plurality of cylinder bores provided in said cylinder blocks for extending in the front and rear direction and parallel to and radially outwardly of said rotary shaft, p0 a plurality of pistons mounted in each of said cylinder bores and reciprocable therein by means of a swash plate which is mounted on said rotary shaft for performing a unitary rotation therewith, and a suction flange and a discharge frange connected respectively to a suction passage and a discharge passage provided in the body member of the compressor, wherein the improvement comprises, an inner housing in the form of a bottomed cylinder mounted in the rear housing for movement axially of said rotary shaft in such a manner that the front end face of the inner housing acts for closing or exposing the rear face of the body member of the compressor through the medium of said rear valve seat, a discharge chamber delimited by a partition wall so as to lie centrally on the front surface of said inner housing, said discharge chamber communicating with said cylinder bores through discharge ports in said valve plate, said discharge chamber also communicating with said discharge passage, a suction chamber delimited on the front surface of the inner housing by said partition wall so as to lie radially outwardly of said discharge chamber, said suction chamber communicating with said cylinder bores through suction ports in said valve seat, said suction chamber also communicating with said suction passage, spring means arranged in said body member for normally urging said inner housing and said valve plate on the front surface thereof towards rear;

a pressure chamber defined between the rear surface of said inner housing and the inner surface of the rear housing, said pressure chamber being operative upon increase in the inside pressure to shift said inner housing and the rear valve plate towards front against the pressure of said spring means for abutting said rear valve plate against the rear end face of the body member of the compressor for stopping up said rear end face, changeover valve means provided halfway in a conduit passage interconnecting said pressure chamber with a high pressure source or a low pressure source, and check valve means provided halfway in said discharge passage for preventing reversed flow of the pressurized gas from said discharge flange into the discharge chamber of said inner housing in the absence of the compression operation in the rear cylinder block.

2. The compressor as claimed in claim 1 wherein the rear wall of the inner housing is formed with a reduced thickness portion with thickness lesser the thickness of said valve plate so as to permit said inner housing to flex at the time of mounting of said housing and the valve plate on the front surface thereof so as to reduce valve plate flexure.

3. The compressor as claimed in claims 1 or 2 wherein said inner housing has an outer wall disposed outwardly of said partition wall to inscribe the outer peripheral wall of said rear housing, the discharge chamber is defined inwardly of said partition wall, and wherein the suction chamber is defined between said partition wall and said outer wall.

4. The compressor as claimed in claims 1 or 2 wherein the suction chamber is defined between the partition wall of the inner housing and the outer peripheral wall of the rear housing.

5. The compressor as claimed in claims 1 or 2 wherein the high pressure source and the low pressure source are the discharge pressure and suction pressure respectively of the discharge flange and the suction flange of the compressor itself.

* * * * *